United States Patent [19]

Gerhards et al.

[11] 4,000,637

[45] Jan. 4, 1977

[54] ROLLING MILLS

[75] Inventors: Hans-Dieter Gerhards, Solingen-Grafrath; Hermann Möltner, Dusseldorf-Oberkassel, all of Germany

[73] Assignee: Firma Friedrich Kocks, Dusseldorf, Germany

[22] Filed: Apr. 16, 1976

[21] Appl. No.: 677,662

[30] Foreign Application Priority Data

Apr. 21, 1975 Germany ..... 2517536

[52] U.S. Cl. ..... 72/226; 72/249

[51] Int. Cl.[2] ..... B21B 17/00; B21B 23/00

[58] Field of Search ..... 72/249, 234, 235, 226

[56] References Cited

UNITED STATES PATENTS

| | | | |
|---|---|---|---|
| 2,757,556 | 8/1956 | Vebing | 72/249 X |
| 3,831,417 | 8/1974 | Ritter et al. | 72/249 X |

*Primary Examiner*—Milton S. Mehr

*Attorney, Agent, or Firm*—Buell, Blenko & Ziesenheim

[57] ABSTRACT

A stretch-reducing rolling mill is provided for selectively producing tubes of circular or angular configuration, such as a square, is provided in the form of a plurality of driven roll stands arranged in two groups, one at the entrance end being equipped with three roller stands and a second at the rear or exit end being arranged to use either three or four roller stands optionally, said first group of stands being driven by a common drive train separate and independent of the drive for the second group.

10 Claims, 2 Drawing Figures

ROLLING MILLS

Figure 1:
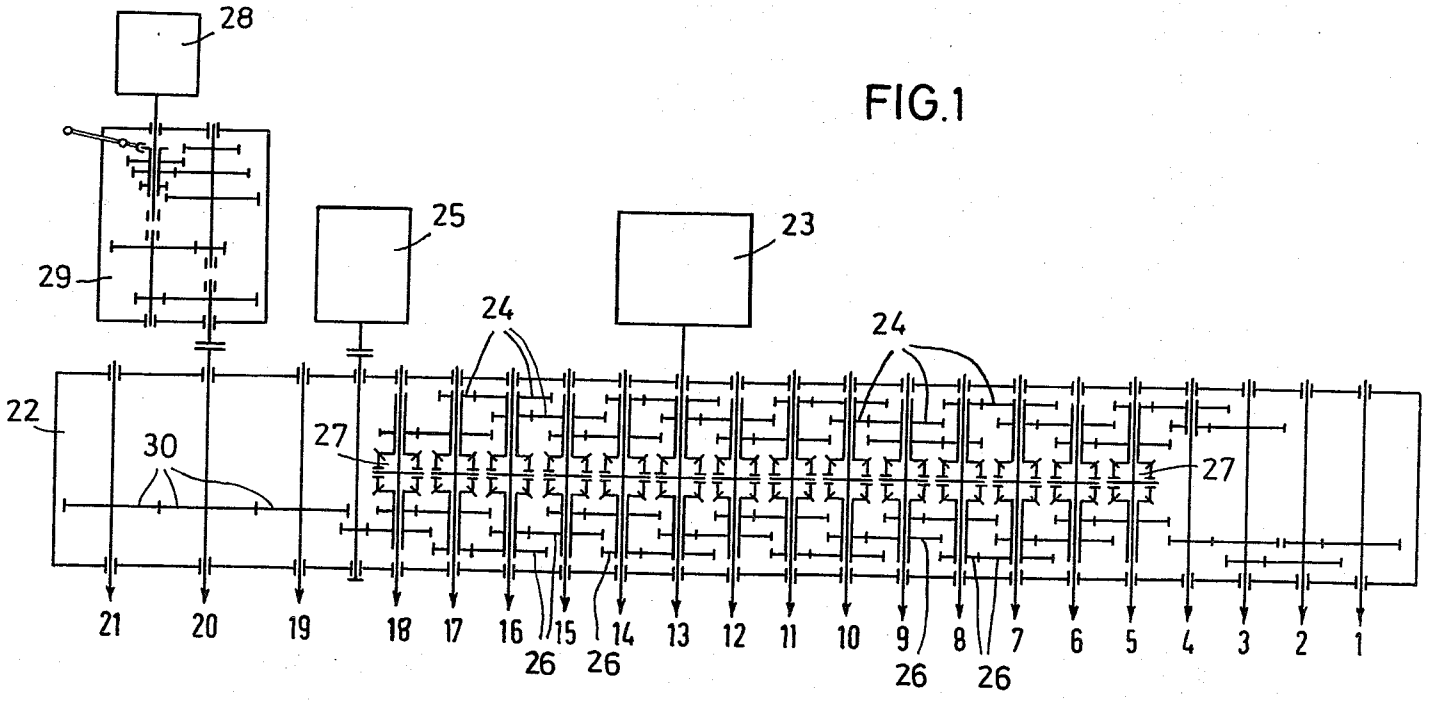

This invention relates to improvements in rolling mills and particularly to a stretch-reducing rolling mill having a plurality of driven stands arranged in stand holders one behind the other in the rolling direction.

In a stretch-reducing rolling mill for producing tubes of circular or angular cross sectional configuration, it has hitherto been possible to employ three-roller or four-roller stands selectively at all the stand locations. The four-roller stands are required for the purpose of obtaining tubes having a square or rectangular cross section. However, in practice, they are used only at the last stand locations of a stretch-reducing rolling mill, since the tubular starting material of circular cross section is first stretched by the front stands, i.e. its diameter and, if required, its wall thickness is reduced, whereas four-roller stands are used only at the last stand locations to impart the desired angular cross sectional configuration to the tube of initially circular cross section. There is scarcely any further elongation of the tube, so that the increase in rotational speed from stand to stand in the case of the rear four-roller stands is substantially less than if the same stand locations were equipped with three-roller stands and were to be used for the normal stretch-reducing of tubes having a circular cross section.

The aforesaid type of construction as described in published German patent specification Offenlegungsschrift No. 2,262,391 is intended to stretch-reduce tubes having a circular cross section as well as to produce tubes having a rectangular or square cross section. For this purpose, all the stand locations, except the very first, are constructed such that they can each receive a three-roller or a four-roller stand. The drive is effected at each stand location by a separate motor which is individually regulable and which, moreover, separately drives a distribution gear of the individual stand locations by way of a respective superimposition transmission unit connected on the input side. The distribution gear has suitable output shafts for an input shaft of a three-roller stand and for two input shafts of a four-roller stand. The superimposition transmission unit has an input differential gear connected to an output differential gear on the one hand by a direct drive and on the other hand by a variable ratio torque converter. By varying the transmission ratio of the torque converter the transmission ratio of the superimposition transmission unit is variable within limits.

This construction having an individual drive has the disadvantage that is very complicated and involves correspondingly high capital expenditure owing to the large number of individual motors and the regulating device which is necessarily rendered complicated thereby. Furthermore, the known rolling mill has the disadvantage that each change in the rolling programme necessitates the complicated and time-consuming adjustment of each individual motor and/or superimposition transmission unit of each stand location. Furthermore, this construction has the additional disadvantage that all the stands have a relatively large stand spacing with respect to each other, proportioned in accordance with the four-roll stands that are adjustable at each stand site. The three-roll stands, which, as is known, require a smaller stand spacing, would necessarily also assume the large stand spacing of the four-roll stands, which result in a corresponding lengthening of the unuseable thickened end of the rolled material, thus, a substantial increase in the proportion of scrap in tube production, and a larger space would also be required for the rolling mill.

A feature of the present invention is to provide a stretch-reducing rolling mill which does not have the aforesaid disadvantages but which, with lower expenditure, can be used to roll tubes having circular or angular cross section of satisfactory quality in an economical manner.

The present invention provides a stretch-reducing rolling mill for optionally producing tubes of circular or angular cross sectional configuration, comprising a plurality of driven stands arranged in stand holders one behind the other in the rolling direction, in which rolling mill the last stand locations in the rolling direction are spaced sufficiently apart for them to be selectively equipped with three-roller or four-roller stands, and the front stand locations cannot be selectively so equipped but are equipped exclusively with three-roller stands which are spaced at distances apart too close for four-roller stands but adapted to the three-roller stands and which are provided with a group drive, the last stand locations which may be equipped selectively with three-roller or four-roller stands being provided with a separate drive which is additional to the group drive of the front stand locations.

Thus, in the first instance, there is no need to provide the complicated individual drives, particularly in the case of the front stand locations which are many times greater in number than the rear stand locations at which the four-roller stands may be required and which also do not require an individual drive. Thus, there is a substantial saving in costs and, furthermore, there is no need to provide the complicated and expensive electrical regulation which is susceptible to trouble, and the difficult and time-consuming adjustment associated therewith is avoided. Furthermore, the rolling mill in accordance with the invention has the substantial advantage that the distances between the stands are as short as possible, thus leading to a considerable shortening of the unusable thickened ends and thus to an economically significant reduction in the proportion of waste. The rolling mill in accordance with the invention is eminently suitable for producing tubes having a square or rectangular cross section, particularly tubes whose sides have greatly differing dimensions. The small number of four-roller stands at the rear stand locations are fully adequate to produce the desired cross sections from a tube having a circular cross sectional configuration which has been produced by stretch-reducing in the three-roller stands at the front stand locations. The separate drive for the small number of rear stand locations can readily be designed such that it is suitable for rolling rectangular tubes by means of four-roller stands and also for rolling by means of three-roller stands. The small amount of extra expenditure conditioned thereby is kept at a low level solely by virtue of the fact that the number of rear stand locations thus equipped is only a small fraction of the total number of stand locations of the rolling mill.

In a preferred embodiment of the invention, the rear stand locations are driven by at least one additional infinitely regulatable motor. Thus, it is possible to obtain the required different rotational speeds of the rear stand locations if, instead of the three-roller stands normally used to produce tubes having a circular cross section, four-roller stands are used which produce tubes having an angular cross sectional configuration. The drive for the rear roller stands can then be constructed many different ways. Thus, it is advantageous if the rear stand locations have a separate group drive with or without differential gears. The entire stretch-reducing rolling mill would then have two separate group drives, that is one group drive for the front stand locations and one group drive for the rear stand locations. Such group drives have the substantial advantage that the mathematically ascertained rotational speed steps from stand to stand are, in fact, complied with in practice, and that the complicated and difficult adjustment of the motor speeds in the case of individual drives is avoided. A rolling mill of this type is less dependent upon the skill of the operators and is made ready for operation again more rapidly upon a change in the rolling program.

Alternatively, it can be advantageous if the rear stand locations also jointly use the series of basic rotational speeds of the front stands in addition to the additional motor or motors. This has the advantage that the total power for the rear stand location does not have to be applied by the additional motor or motors, so that the latter can be of smaller dimensions, thus affording economical and structural advantages. Furthermore, this embodiment is advantageous when tubes having a circular cross section are manufactured in the rolling mill and the rear stand locations are also only equipped with three-roller stands, so that the continuous series of rotational speeds customary in conventional stretch-reducing rolling mills is required. It will be appreciated that, basically, it is also possible to drive the rear stand locations individually.

In a further embodiment of the invention, an intermediate transmission unit, preferably a speed change gearbox, is interposed between the additional motor or motors and the rear stand locations. Since the d.c. motors used as additional motors usually produce a uniform output only in a rotational speed range of approximately 1:3, although a uniform output over a rotational speed range of approximately 1:12 is desirable for the drive for the rear stand locations, the control transmission unit has the advantage that it effects this increase in the rotational speed range with the same drive power.

Figure 2:
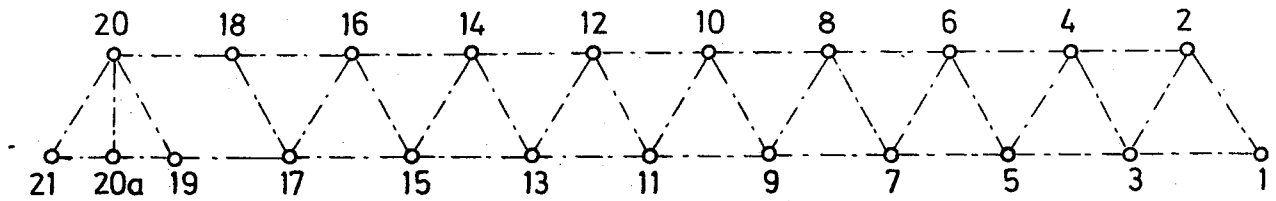

The invention is further described by way of example, with reference to the accompanying drawings, in which:

FIG. 1 is a diagrammatic plan view of a drive for a stretch-reducing rolling mill in accordance with the invention; and FIG. 2 is a diagrammatic front view of the position of the drive couplings for the roller stands.

Referring to FIG. 1, the output drive shafts of a transmission unit 22 are designated 1 to 21, and a respective roller stand (not illustrated) can be connected to each drive shaft. Drive shafts 1 to 18 are driven by means of a main motor 23 which acts upon these drive shafts at respective basic rotational speeds. The basic rotational speed is different for each of drive shafts 1 to 18, such that the drive shaft 1 is driven at the lowest rotational speed and the drive shaft 18 is driven at the highest rotational speed. This increase in the rotational speed from shaft 1 to shaft 18 substantially corresponds to the stretching of the work-material in the individual stands and the constantly increasing run-through speed caused thereby. This series of basic rotational speeds is transmitted from shaft 13, which is directly driven by the motor 23, by meshing spur gears 24 arranged on the motor side in the transmission unit 22, wherein it will be clearly seen that, viewed from the motor 23, the rotational speed is continuously stepped down towards the entry side, i.e. towards drive shaft 1, whereas the rotational speeds is continuously stepped up towards the delivery side, i.e. towards drive shaft 18.

An additional motor 25 acts secondly upon drive shafts 5 to 18 with an additional series of rotational speeds which is transmitted by meshing spur gears 26 which are arranged in the transmission unit housing 22 at the side facing the roller stands (not illustrated). Drive shafts 1 to 4 are not acted upon by this additional series of rotational speeds but, driven by the motor 23, rotate only at their respective basic rotational speeds.

The particular additional rotational speed is superimposed on the particular basic rotational speed in a respective differential gear 27 to form the final rotational speed of the relevant drive shaft. Since only the basic rotational speed needs to be imparted to drive shafts 1 to 4, it is unnecessary to arrange superimposing differential gears 27 at drive shafts 1 to 4.

As may be seen by a comparison with FIG. 2, the drive diagram of FIG. 1 is illustrated in an extended form, in order to clarify the illustration. However, in reality, drive shafts 1 to 18 do not lie in one plane but are located alternately on two different planes since, owing to the alternating arrangement of the rollers, the three-roller stands to be connected to drive shafts 1 to 18 have their drive shafts arranged alternately above and below and consequently also have to be arranged alternately above and below the drive shafts. Since drive shafts 1 to 18 are provided exclusively for driving three-roller stands in the present case, odd-numbered drive shafts are located on the lower plane, while all even-numbered drive shafts are arranged on the upper plane.

The same aforementioned principle is also observed in the case of drive shafts 19, 20 and 21, since these drive shafts should also be able to drive three-roller stands when the entire stretch-reducing rolling mill is used to produce tubes having a circular cross sectional configuration. However, it will be clearly seen from FIG. 1 that the horizontal distances between the axes of drive shafts 18 and 19 and between the axes of the following drive shafts are greater than the uniform horizontal distances between the axes of the drive shafts having the lower identification numerals. The reason for this is that drive shafts 19, 20 and 21 should also be provided to drive roller stands having four rollers in which the rollers are not staggered relatively to one another when viewed in the cross section of the work-material and therefore cannot be nested into one another and consequently require a greater distance between the stands and thus a greater distance between their drive shafts.

FIG. 2 is not drawn to scale so that the differing horizontal spacings between the drive shafts 1 to 18 on the one hand and the drive shafts 19 to 21 on the other hand are not apparent from FIG. 2.

However, drive shafts 19, 20 and 21 primarily require a different drive and not only greater distances between their axes. By virtue of the requirement that they should, firstly, drive three-roller stands in conformity with drive shafts 1 to 18, and, secondly, that they are also intended for four-roller stands, it is necessary to take these different operating states into account with respect to the drive. Therefore, in the illustrated embodiment, drive shafts 19, 20 and 21 are driven by an additional motor 28. An intermediate transmission unit 29 is arranged between the motor 28 and the main transmission unit 22. The intermediate transmission unit 29 is a speed change gearbox so that the motor 28, which is a regulable d.c. motor, can drive over a greatest possible range of rotational speed with a substantially constant power output. Drive shafts 19, 20 and 21 are driven by way of the intermediate transmission unit 29. Their shafts are interconnected by way of meshing spur gears 30 which have a transmission ratio of substantially 1:1. The reason for this is that the last stands of the stretch-reducing rolling mill, irrespective of whether these stands are in the form of three-roller or four-roller stands, essentially form sizing roller stands in which the deformation, particularly the stretching, of the work-material is only very slight, so that there is no increase in the rotational speed, or only a very slight increase, from drive journal to drive journal in the direction in which the work-material passes through the rolling mill.

FIG. 2 clearly shows that drive shaft 19, 20 and 21 constitute a continuation of the zig-zag arrangement of drive shafts 1 to 18, since, in the case of drive shafts 19, 20 and 21, the odd-numbered drive shafts are also arranged below and the even-numbered drive shafts are arranged above. This is necessary when drive shafts 19, 20 and 21 also drive three-roller stands. If they are used to drive four-roller stands having a drive shaft located at the bottom, an additional second drive shaft 20*a* is arranged below drive shaft 20 and rotates at the same speed as drive shaft 20. Consequently, it is also possible to drive a four-roller stand at the stand location associated with drive shaft 20, the drive shaft of the four-roller stand being located on the lower plane. Basically, it is also possible to provide, in a similar manner, additional drive shaft in the upper plane above drive shafts 19 and 21 although they are not shown in FIG. 2 and are also not required in the illustrated embodiment.

Instead of the single drive motor 28 for the three last stand locations, three separate drive motors can be provided to rotate drive shafts 19, 20 and 21. Another possibility is for drive shafts 19, 20 and 21 to receive a basic rotational speed from the group drive motor 23 via differential gears which are connected also to a common additional motor or individual additional motors like but separate from the motor 25. A further possibility is to provide a separate group drive for drive shafts 19, 20, 21 with or without differential gears.

In the foregoing specification certain preferred practices and embodiments of this invention have been set out, however, it will be obvious to men skilled in this art that this invention may be otherwise embodied within the scope of the following claims.

We claim:

1. A stretch-reducing rolling mill for optionally producing tubes having a final circular or angular cross-sectional configuration, comprising a plurality of driven roll stands arranged in stand holders one behind the other in the rolling direction, said roll stands and holders being divided into a first and a second group in which rolling mill the second stand holders are last in the rolling directions and are spaced sufficiently apart for them to be selectively equipped with three-roller or four-roller stands, and in which the first or front stand holders cannot be selectively so equipped but are equipped exclusively with three-roller stands, said front stand holders being spaced at distances apart too close for four-roller stands but adapted to the three-roller stands, said front holders being provided with a group drive, and said last stand holders, which may be equipped selectively with three-roller or four-roller stands, being provided with a separate drive independent of the group drive of the front stand holders.

2. A rolling mill as claimed in claim 1 in which the group drive for the first stands includes a common main drive motor driving all of said first stands and differential transmissions for at least some of the stand locations adjacent the second stands to enable the roller speeds at those locations to be varied independently to the speed of the main drive motor.

3. A rolling mill as claimed in claim 1 in which the drive for the second stand locations comprises at least one additional infinitely regulable motor.

4. A rolling mill as claimed in claim 2 in which the drive for the second stand locations comprises at least one additional infinitely regulable motor.

5. A rolling mill as claimed in claim 3 in which the drive for the second stands is a separate group device, with differential gears.

6. A rolling mill as claimed in claim 3 in which the drive for the second stands is a separate group drive, without differential gears.

7. A rolling mill as claimed in claim 3 in which the rear second stands also jointly use the series of basic rotational speeds of the front first stands in addition to the additional at least one drive motor.

8. A rolling mill as claimed in claim 3 in which the rear second stands are provided with individual drive motors.

9. A rolling mill as claimed in claim 3 in which an intermediate transmission unit is interposed between the additional at least one motor and the rear second stand location.

10. A rolling mill as claimed in claim 9 in which the intermediate transmission unit is a speed-change gearbox.

* * * * *